US006155233A

United States Patent [19]

Wade et al.

[11] Patent Number: 6,155,233

[45] Date of Patent: Dec. 5, 2000

[54] COMBINATION PRESSURE SENSOR AND REGULATOR FOR DIRECT INJECTION DIESEL ENGINE FUEL SYSTEM

[75] Inventors: Richard A. Wade, Shelby, N.C.; Thomas K. James, Royal Oak, Mich.; William P. Page, Kings Mountain, N.C.; Paul P. M. Beuger; Joseph A. Stain, both of Shelby, N.C.

[73] Assignee: FASCO Controls Corp., Shelby, N.C.

[21] Appl. No.: 09/391,643

[22] Filed: Sep. 7, 1999

[51] Int. Cl.[7] ..... F02M 37/04

[52] U.S. Cl. ..... 123/458; 137/487.5

[58] Field of Search ..... 123/458, 457, 123/494; 137/487.5; 251/129.06

[56] References Cited

U.S. PATENT DOCUMENTS

| | | | |
|---|---|---|---|
| 4,353,385 | 10/1982 | Maisch et al. | 123/511 |
| 4,796,661 | 1/1989 | Hishinuma | 137/487.5 |
| 4,838,232 | 6/1989 | Wich | 123/458 |
| 5,988,210 | 11/1999 | Komiya et al. | 137/487.5 |
| 6,026,847 | 2/2000 | Reinicke | 137/487.5 |
| 6,079,392 | 6/2000 | Matsuda | 123/458 |

*Primary Examiner*—Thomas N. Moulis
*Attorney, Agent, or Firm*—Myers Bigel Sibley & Sajovec, P.A.

[57] ABSTRACT

A pressure regulating device for high pressure diesel fuel systems includes a pressure sensing element attached directly to a wall adjacent a fuel inlet passageway that generates electrical signals responsive to stresses imposed on the wall by fuel pressure within the fuel inlet passageway. The pressure sensing element includes a semiconductor element that deflects in response to a deflection of a portion of the pressure caused by fuel pressure within fuel inlet passageway. A coil is electrically connected with the pressure sensing element and is configured to generate a magnetic field that moves a magnetic armature to control fuel pressure.

20 Claims, 4 Drawing Sheets

COMBINATION PRESSURE SENSOR AND REGULATOR FOR DIRECT INJECTION DIESEL ENGINE FUEL SYSTEM

FIELD OF THE INVENTION

The present invention relates generally to pressure regulating devices and, more particularly, to pressure regulating devices for fuel systems.

BACKGROUND OF THE INVENTION

To enhance the performance of diesel engines, vehicle manufacturers have begun investigating the use of direct injection fuel systems. In a direct injection fuel system, a fuel injector injects highly pressurized diesel fuel directly into an engine cylinder combustion chamber during the compression stroke. Direct fuel injection can facilitate better mixture of diesel fuel and air, which can lead to a cleaner and more controllable burn, thus enhancing engine performance.

Diesel engines typically rely solely on compression to ignite the fuel/air mixture. Compression pressures within a diesel engine can reach very high levels (e.g., about 2000 Bar or 29,000 psi). Because diesel fuel is injected during the compression stroke, the diesel fuel must also be at a high pressure in order to enter the cylinder. High fuel pressure is typically achieved by using a high-pressure booster pump in conjunction with a low pressure fuel tank pump.

FIG. 1 is a schematic illustration of a conventional direct injection fuel system 5 for a diesel engine. Diesel fuel is pumped from a tank 10 via a low pressure fuel tank pump 12 to a high pressure booster pump 14. The high pressure booster pump 14 raises the pressure of the diesel fuel so that the diesel fuel can enter a combustion chamber against the compression pressure in the cylinder. Typically, a high pressure booster pump is mounted to an engine and is operated directly from a cam (or crank) shaft within the engine. As illustrated in FIG. 1, the high pressure diesel fuel discharged from the high pressure booster pump 14 flows through a fuel rail 16 and to each injector 18 via a respective fuel passageway 20. Each injector 18 is configured to deliver a controlled amount of diesel fuel into a respective cylinder 22 when activated by an engine control unit (ECU) 24. Conventionally, fuel pressure in a fuel rail 16 is controlled via a fuel rail pressure regulator 26 and a fuel rail pressure sensor 28. Typically, the pressure sensor 28 and pressure regulator 26 communicate with each other via an ECU 24.

Because two separate components (i.e., a pressure regulator and a pressure sensor) are typically used to control fuel pressure in conventional direct injection fuel systems, multiple connections in a fuel rail are typically necessary. Unfortunately, each connection in a high pressure fuel rail is a potential source of fuel leakage. Because fuel rails are typically mounted near hot exhaust manifolds, the potential for fire caused by a fuel leak from a high pressure fuel rail can be substantial.

SUMMARY OF THE INVENTION

In view of the above discussion, it is an object of the present invention to facilitate reducing the potential for fire caused by fuel leaks in high pressure direct injection fuel systems for diesel engines.

It is another object of the present invention to provide fuel pressure monitoring and control for high pressure direct injection fuel systems wherein only a single connection in a fuel rail is required.

These and other objects of the present invention can be provided by pressure regulating devices for high pressure fuel systems described herein. A pressure regulating device according to an embodiment of the present invention includes a housing and a body extending from the housing. The body includes an axial bore extending through a portion thereof that defines a longitudinal direction. A fuel inlet passageway and a fuel outlet passageway are in fluid communication with the axial bore.

A cavity is formed in the body adjacent the fuel inlet passageway and is configured to house a pressure sensing element. The pressure sensing element is configured to generate electrical signals responsive to stresses imposed on the wall of the body adjacent the fuel inlet passageway caused by fuel pressure within the fuel inlet passageway.

An elongate regulating pin is slidably disposed within the axial bore and is movable within the axial bore along the longitudinal direction between an open position in which fuel may flow from the fuel inlet passageway into the axial bore and a closed position in which fuel flow from the fuel inlet passageway is blocked by an end of the regulating pin. Movement of the regulating pin regulates fuel pressure within the fuel inlet passageway by allowing fuel entering the axial bore via the fuel inlet passageway to exit via the fuel outlet passageway. Movement of the regulating pin in a direction away from the fuel inlet passageway may be limited by a stop disposed within the axial bore.

A tube assembly is surrounded by a magnetic coil disposed within the housing. The tube assembly includes an inner tube, having an elongated bore in communication with the body axial bore, disposed within an outer tube. A magnetic pole piece is disposed within the inner tube bore and a magnetic armature is slidably secured within the inner tube bore adjacent the magnetic pole piece. A spring is disposed within the inner tube bore between the pole piece and armature and serves as means for biasing the armature away from the pole piece such that an end of the armature is maintained in contacting relationship with an end of the regulating pin. The magnetic coil is configured to generate, responsive to electrical signals generated by the pressure sensing element, a magnetic field that moves the magnetic armature axially within the tube bore to regulate fuel pressure within the fuel rail.

A pressure sensing element is configured to measure stresses on the wall of the body produced by fuel pressure within the fuel inlet passageway. The pressure sensing element includes a semiconductor element that deflects in response to a deflection of the outer tube second end caused by pressure within the pressure chamber. The magnetic coil disposed within the housing is electrically connected with the pressure sensing element and is configured to generate a magnetic field responsive to electrical signals from the pressure sensing element. The magnetic field moves the magnetic armature axially within the inner tube to control fuel pressure by allowing fuel entering the pressure chamber via the fuel inlet passageway to exit via a fuel outlet passageway.

Because the present invention combines a pressure sensing element and pressure regulator within a single device, only a single connection in a fuel rail is required. Accordingly, the number of potential sources of fuel leaks in a fuel rail can be reduced by the present invention.

According to another embodiment of the present invention, controller, such as a proportional-integral-derivative (PID) controller, may be electrically connected with the pressure sensing element to create a "smart solenoid" whereby fuel pressure can be maintained within a prescribed range of pressures. The controller closes the loop around the sensed pressure via the pressure sensing element and adjusts the voltage to the coil which controls the axial movement of the magnetic armature within the inner tube in order to maintain fuel pressure within a predetermined range.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout the description of the figures.

Figure 2:
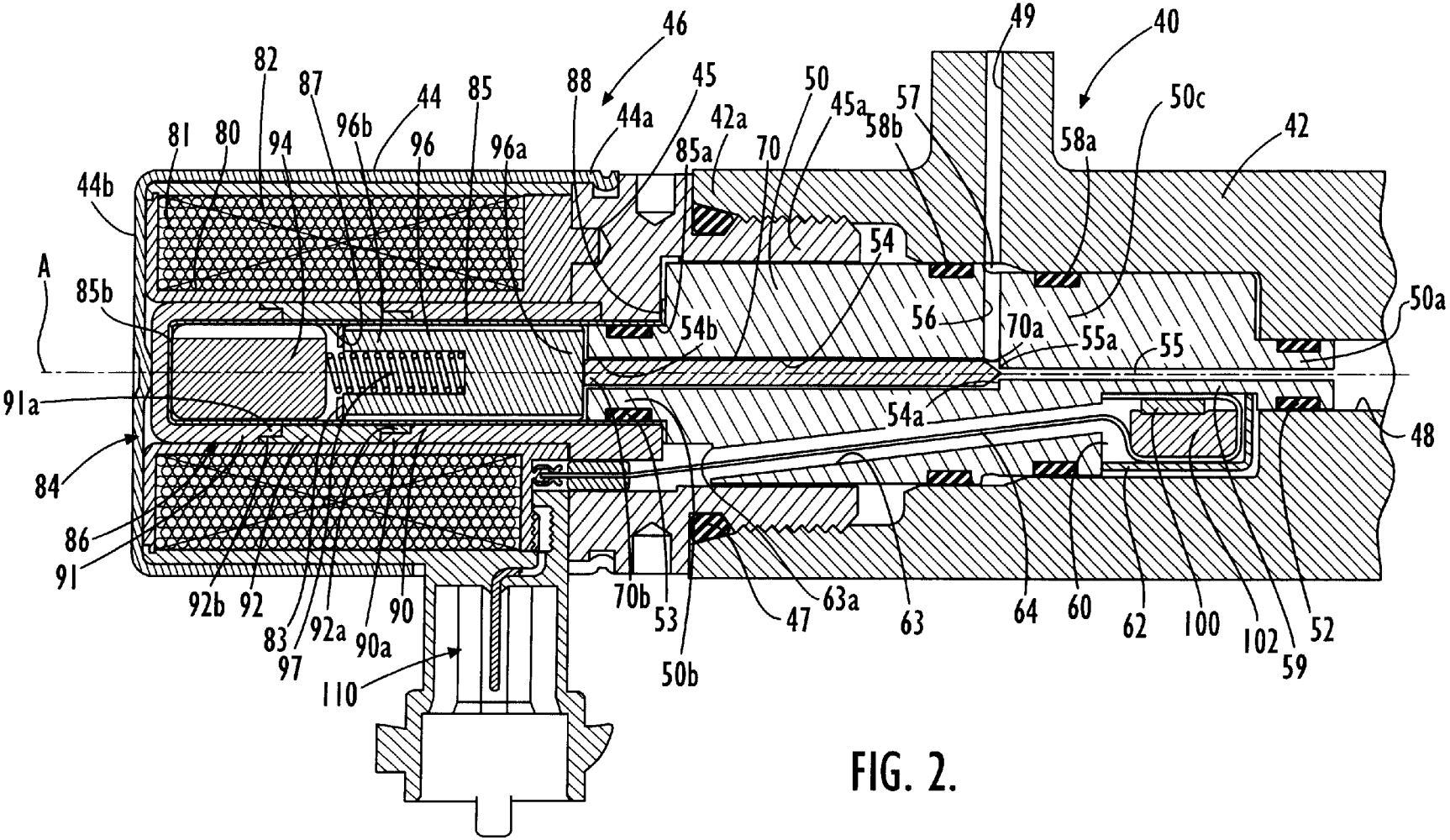
FIG. 2 is a side section view of a fuel pressure regulating apparatus according to an embodiment of the present invention.

Referring now to FIG. 2, a pressure regulating apparatus 40 according to an embodiment of the present invention is illustrated. The illustrated pressure regulating apparatus 40, which is in fluid communication with a fuel rail 42, includes an annular magnetic flux housing 44 secured to a threaded plug 45, which together are collectively referred to herein as the housing 46 of the regulating apparatus 40. The threaded plug 45 includes an externally threaded end portion 45*a* that is configured to threadingly engage an internally threaded end portion 42*a* of the fuel rail 42, as illustrated. An O-ring 47 is configured to maintain a sealed engagement between the threaded plug 45 and the fuel rail 42 as would be understood by one skilled in the art.

The illustrated fuel rail 42 includes a first passageway 48 that delivers high pressure fuel to a plurality of fuel injectors. As will be described below, the pressure regulating apparatus 40 is in fluid communication with the fuel rail first passageway 48 and is configured to measure and regulate the pressure of the fuel within the fuel rail first passageway 48. The illustrated fuel rail 42 also includes a second passageway 49 through which fuel within the pressure regulating apparatus 40 exits.

An elongated body 50 having opposite first and second end portions 50*a*, 50*b* separated by an intermediate portion 50*c* extends from the housing 46 as illustrated. The elongated body 50 is configured to be received within the fuel rail 42 when the threaded plug end portion 45*a* is threadingly engaged with the fuel rail end portion 42*a*. The elongated body first end portion 50*a* is configured to be received within the fuel rail first passageway 48 as illustrated. The elongated body second end portion 50*b* is configured to be received within a non-magnetic inner tube 85 disposed within the housing 46. The inner tube 85 is described in detail below.

In the illustrated embodiment, an O-ring 52 is configured to maintain a sealed engagement between the fuel rail first passageway 48 and the elongated body first end portion 50*a* to prevent fuel leakage therebetween, as would be understood by one skilled in the art. Similarly, an O-ring 53 is configured to maintain a sealed engagement between the inner tube 85 and the elongated body second end portion 50*b* to prevent fuel leakage therebetween, as would be understood by one skilled in the art.

The elongated body 50 includes an axial bore 54 extending through a portion thereof. The axial bore 54 includes opposite first and second end portions 54*a*, 54*b* and defines a longitudinally extending axial direction, indicated by reference letter A. The axial bore 54 is configured to slidably receive an elongated regulating pin 70 therein that is described in detail below.

The elongated body 50 also includes a fuel inlet passageway 55 and a fuel outlet passageway 56 that are in fluid communication with the elongated body axial bore 54, as illustrated. The fuel inlet passageway 55 extends along the axial direction A between the axial bore first end 54*a* and the elongated body first end 50*a* and is in fluid communication with the fuel rail first passageway 48.

The fuel outlet passageway 56 extends between the axial bore first end 54*a* and an aperture 57 formed in the elongated body intermediate portion 50*c* and along a direction that is transverse to the axial direction A. The fuel outlet passageway 56 is in fluid communication with the fuel rail second passageway 49. In the illustrated embodiment, a pair of O-rings 58*a*, 58*b* are positioned on opposite sides of the aperture 57 formed in the elongated body intermediate portion 50*c*. The O-rings 58*a*, 58*b* are configured to maintain a sealed engagement between the fuel rail 42 and the elongated body intermediate portion 50*c* to prevent fuel leakage therebetween, as would be understood by one skilled in the art.

The elongated body 50 includes a cavity 60 provided therein between the elongated body first end 50*a* and the axial bore first end 54*a* and adjacent the fuel inlet passageway 55, as illustrated. The cavity 60 is configured to house a pressure sensing element 100 therein. A wall 62 is configured to enclose the cavity 60 and thereby protect the pressure sensing element 100 from the external environment.

The pressure sensing element 100 is configured to generate electrical signals responsive to stresses imposed on the elongate body 50 adjacent the fuel inlet passageway 55 caused by fuel pressure within the fuel inlet passageway 55. A conduit 63 extends from the cavity 60 to an outlet 63*a* formed in the elongated body 50 adjacent the elongated body second end 50*b*, as illustrated.

A flexible dielectric film 64 containing electrical traces extends through the conduit 63 and electrically connects the pressure sensing element 100 with the coil 82 and electrical connectors 110. Flexible dielectric films, such as KAPTON® flexible film (E. I. du Pont de Nemours and Company, 1007 Market St., Wilmington, Del.), are well known by those having skill in the art and need not be described further herein.

An elongated regulating pin 70 is slidably disposed within the elongated body axial bore 54, as illustrated. The regulating pin 70 includes opposite first and second ends 70*a*, 70*b* and is movable within the axial bore 54 along the axial direction A between an open position in which fuel may flow from the fuel inlet passageway 55 into the axial bore 54 and a closed position in which fuel flow from the fuel inlet passageway 55 is blocked by the regulating pin first end 70*a*. The end 55*a* of the fuel inlet passageway 55 serves as a poppet seat for receiving the regulating pin first end 70*a* in mating relationship.

Figure 3:
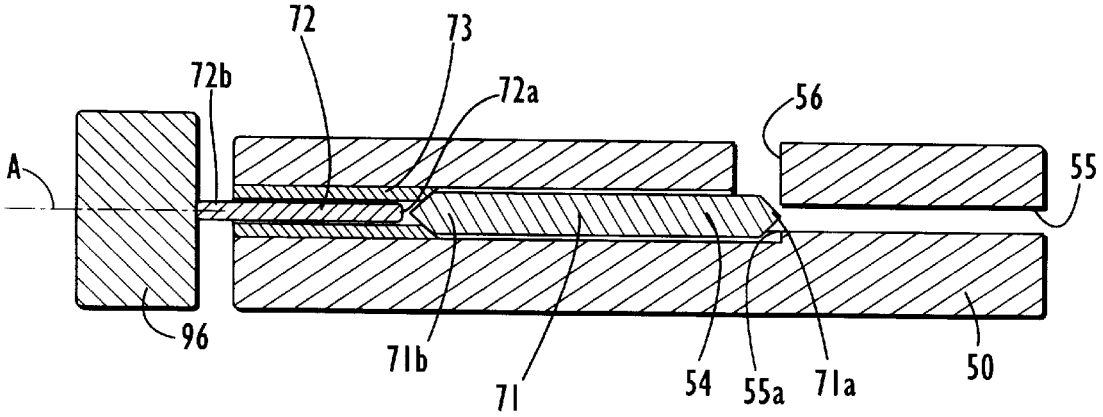
FIG. 3 is an enlarged side section view of a two-piece regulating pin according to an embodiment of the present invention.

Referring to FIG. 3, an alternative embodiment of a regulating pin and body axial bore for a pressure regulating apparatus according to the present invention is illustrated. The illustrated regulating pin 70 has first and second portions 71, 72 that can move within the axial bore 54 independently of each other. The regulating pin first portion 71 includes opposite first and second ends 71*a*, 71*b* and is movable within the axial bore 54 along the axial direction A between an open position in which fuel may flow from the fuel inlet passageway 55 into the axial bore 54 and a closed position in which fuel flow from the fuel inlet passageway 55 is blocked by the first end 71*a* of the regulating pin first portion 71. The end 55*a* of the fuel inlet passageway 55 serves as a poppet seat for receiving the first end 71*a* of the regulating pin first portion 71 in mating relationship.

A stop 73 is disposed within the axial bore 54 and prevents the regulating pin first portion from moving towards the armature 96 by more than a predetermined distance. Furthermore, the second end 71*b* of the regulating pin first portion 71 is configured to create a seal with the stop 73 to force fuel flow to exhaust through the fuel outlet passageway 56 during a high pressure event.

The regulating pin second portion 72 includes opposite first and second ends 72*a*, 72*b*. The first end 72*a* of the regulating pin second portion 72 is configured to engage the second end 71*b* of the regulating pin first portion 71. The second end 72*b* of the regulating pin second portion 72 is configured to engage the armature 96.

Under normal operating conditions, fuel pressure within the fuel inlet passageway 55 creates a force on the first end 71*a* of the regulating pin first portion 71. This force is transferred through the regulating pin second portion 72 to the armature 96. The spring (97, FIG. 2) opposes the force transferred to the armature 96. As fuel pressure increases, the first end 71*a* of the regulating pin first portion 71 is moved away from the fuel inlet passageway 55. The force transferred to the armature 96 by the fuel pressure causes the spring (97, FIG. 2) to compress. When fuel pressure is extremely large, the regulating pin first portion 71 will move towards the armature 96 until the regulating pin second end 71*b* contacts the stop 73. The second end 71*b* of the regulating pin first portion preferably creates a seal with the stop 73 and forces the fuel to exit through the fuel outlet passageway 56.

Referring back to FIG. 2, the annular flux housing 44 has opposite first and second end portions 44*a*, 44*b*. The annular flux housing 44 is configured to enclose an annular, insulating bobbin 80 disposed therewithin. The annular bobbin 80 has conductive wire 81 coiled therearound to define a coil 82 for generating a magnetic field when electrical current flow is induced therein.

Disposed within the center of the annular bobbin 80 is a tube assembly 84. The tube assembly 84 includes a non-magnetic inner tube 85 disposed within an outer tube 86. The non-magnetic inner tube 85 includes an open end 85*a* and an opposite closed end 85*b* and defines an elongated bore 87 that is in communication with the body axial bore 54. The non-magnetic inner tube open end 85*a* includes a radially extending flange 88 adjacent thereto as illustrated. The flange 88 is secured between the annular plug 45 and the elongated body 50 as illustrated.

The illustrated outer tube 86 includes magnetic first and second portions 90, 91 separated by a non-magnetic intermediate portion 92. The outer tube first, second and third portions 90, 91, 92 are preferably mechanically joined together. The outer tube first, second and third portions 90, 91, 92 may be threadingly engaged. The outer tube first, second and third portions 90, 91, 92 may also be joined together in various other ways, including, but not limited to, brazing and welding. The illustrated non-magnetic intermediate portion 92 includes a first end portion 92*a* that is in interdigitated relationship with an end portion 90*a* of the magnetic first portion 90. The illustrated non-magnetic intermediate portion 92 also includes an opposite second end portion 92*b* that is in interdigitated relationship with an end portion 91*a* of the magnetic second portion 91.

Preferably, the inner tube 85 and the outer tube non-magnetic intermediate portion 92 are formed from non-magnetic material including, but not limited to, non-magnetic stainless steel.

The pressure regulating apparatus 40 has various features that allow the pressure regulating apparatus 40 to operate safely in the presence of high fuel pressures. A first feature is that the inner tube flange 88 is secured between the annular plug 45 and the elongated body 50. Second, the outer tube first, second and third portions 90, 91, 92 are mechanically joined together. A third feature is that the annular flux housing first end 44*a* is mechanically crimped to the threaded plug 45 as illustrated in FIG. 2.

A magnetic pole piece 94 is fixed within the inner tube bore 87 adjacent the inner tube closed end 85*b*. A magnetic armature 96 is slidably secured within the inner tube bore 87 adjacent the magnetic pole piece 94 and includes opposite first and second ends 96*a*, 96*b*. The magnetic armature 96 is configured to move along the axial direction A in response to a magnetic field generated by the coil 82. A spring 97 is disposed between the magnetic armature 96 and pole piece 94. The spring 97 serves as means for biasing the magnetic armature 96 away from the magnetic pole piece 94 along the axial direction A such that the magnetic armature first end 96*a* is maintained in contacting relationship with the regulating pin second end 70*b*. An air gap shim 83 is positioned between the magnetic armature 96 and the magnetic pole piece 94 as illustrated. The air gap shim 83 is preferably formed from non-magnetic material and is configured to prevent magnetic "latch" from occurring between the magnetic armature 96 and the magnetic pole piece 94, as would be understood by one of skill in the art.

The annular flux housing 44, magnetic armature 96, magnetic pole piece 94 and outer tube first and second portions 90, 91 form a magnetic flux circuit. Flow of electrical current within the coil 82 produces a magnetic field via the magnetic flux circuit that causes the magnetic armature 96 to move in the axial direction A within the inner tube 85. The spring 97 biases against the magnetic armature to counter the magnetic force attracting the magnetic armature 96 towards the pole piece 94. As would be understood by one of skill in the art, the amount of movement of the magnetic armature 96 may be controlled by controlling the amount of electrical current applied to the coil 82 and/or by selecting a spring that has a desired spring rate.

The coil 82 generates a magnetic field which causes magnetic flux to flow through the flux housing 44 and down to the magnetic threaded plug 45. The magnetic flux moves from the threaded plug 45 to the outer tube magnetic first portion 90. The magnetic flux then jumps across the non-magnetic inner tube 85 to the magnetic armature 96 and then across the air gap to the magnetic pole piece 94. The magnetic flux leaves the pole piece 94 and enters the outer tube magnetic second portion 91 and then returns to the flux housing 44 to repeat the loop through the flux circuit.

The flow of magnetic flux through the above-described flux circuit causes the magnetic armature 96 to move axially within the inner tube 85 and serves as means for moving the regulating pin 70 between open and closed positions to regulate fuel pressure within the fuel rail 42. The magnetic flux force is assisted by the fuel pressure force pushing on the regulating pin first end 70*a* at the poppet seat (fuel inlet passageway end 55*a*). Opposing these two forces is the force of the spring 97. The balancing of these forces is what allows for pressure regulation of fuel within the fuel rail 42. Coils for moving magnetic armatures (or solenoids) are well understood by those skilled in this art and need not be described further herein.

The pressure sensing element 100 is preferably an electrical resistive strain device that includes a semiconductor element having an embedded resistive element such as a Wheatstone bridge. As is known to those of skill in the art, electrical resistive strain devices produce a varying resistance when strained by a mechanical force. The semiconductor element is preferably a planar substrate formed from silicon. However, the semiconductor element may have various configurations and may be formed from various materials.

As fuel pressure increases within the fuel inlet passageway 55, caused by increased fuel pressure in the fuel rail 42, stresses are imparted on the wall 59 of the elongated body 50 adjacent the fuel inlet passageway 55. The elongated body wall 59 deflects when subjected to stresses caused by fuel pressure within the fuel inlet passageway 55. Deflection of the elongated body wall 59 causes the semiconductor element within the pressure sensing element 100 to deflect and, thus, change resistance. By supplying a voltage to the pressure sensing element 100, a sensed voltage that is proportional to the amount of fuel pressure within the fuel inlet passageway 55 can be generated. By applying a plurality of known pressures within the fuel inlet passageway 55 and monitoring the voltage changes induced on the pressure sensing element 100 by these known pressures, the pressure sensing element 100 can be accurately calibrated to produce a pressure transducer. An exemplary pressure sensing element 100 is disclosed in co-pending and co-assigned U.S. patent application Ser. No. 08/840,363, filed Apr. 28, 1997, which is incorporated herein by reference in its entirety.

An exemplary output signal from the pressure sensing element 100 is a 0.0–5.0 volt direct current (DC) analog signal. However, the output from the pressure sensing element 100 may also be a digital data stream. The output from the pressure sensing element 100 is preferably generated internally via an application specific integrated circuit (ASIC) which has a processor built therein. Preferably, the processor takes a voltage reading from the pressure sensing element 100 and a voltage reading that is proportional to temperature and generates the output voltage. A static ground protection system and an electro-magnetic interference (EMI) circuit are preferably utilized to dampen out background radiation. Static ground protection systems and EMI circuits are well known by those of skill in the art and need not be described further herein.

Terminals 110 within the socket 114 may be provided to perform various functions, including: providing electrical power to the coil 82; providing an output line from the pressure sensing element 100; providing power to the pressure sensing element 100; and providing ground.

Direct Injection Fuel System

Figure 1:
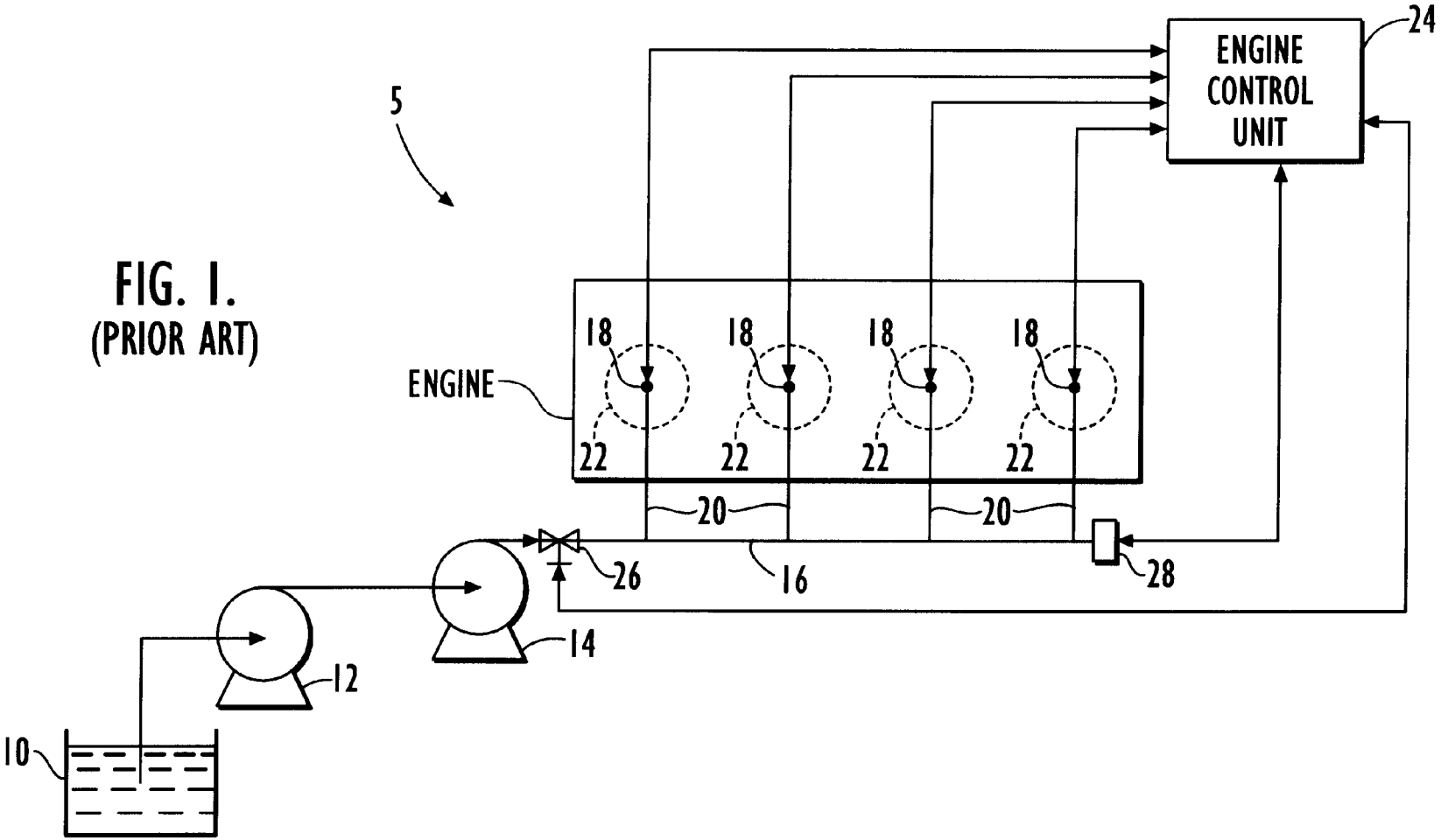
FIG. 1. (PRIOR ART)
FIG. 1 is a schematic illustration of a conventional direct injection fuel system for a diesel engine.
Figure 4:
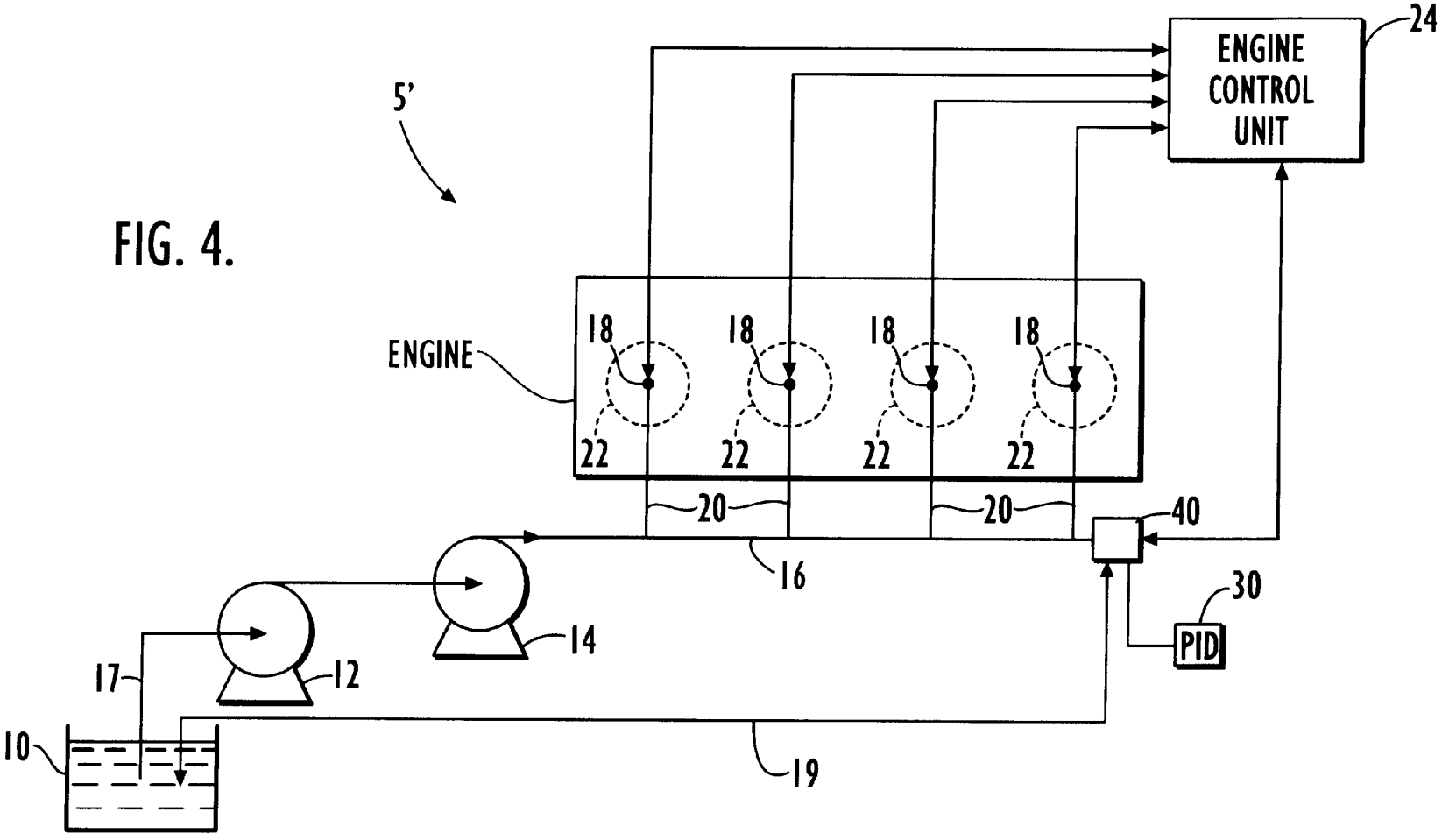
FIG. 4 is a schematic illustration of a direct injection fuel system incorporating a fuel pressure regulating apparatus according to the present invention.

Referring now to FIG. 4, a direct injection fuel system 5' for a diesel engine incorporating a pressure regulating apparatus 40 according to the present invention is schematically illustrated. The illustrated direct injection fuel system 5' includes a fuel tank 10, a fuel rail 16, and a fuel supply line 17 connecting the fuel tank 10 and the fuel rail 16. A high pressure booster pump 14 is provided for pumping diesel fuel from the fuel tank 10 to the fuel rail 16 via the fuel supply line 17. As described above with respect to FIG. 1, a low pressure fuel pump 12 may also be utilized, as would be understood by one skilled in the art. A plurality of fuel injectors 18 are in fluid communication with the fuel rail 16 and each fuel injector 18 is configured to directly inject diesel fuel from the fuel rail 16 into a respective combustion chamber 22 within the diesel engine.

A pressure regulating apparatus 40 as described above is in fluid communication with the fuel rail 16. A fuel return line 19 connects the pressure regulating apparatus 40 and the fuel tank 10 and is configured to return fuel exiting from the pressure regulating apparatus 40 to the fuel tank 10.

As will be described below, a controller 30 may be electrically connected with the pressure sensing element (100, FIG. 2) within the pressure regulating apparatus 40 and configured to maintain fuel pressure within a prescribed range of pressures based upon the requested input. The controller 30 may be a proportional controller, a derivative controller, an integral controller, or some combination thereof. For example, the controller 30 may be a proportional-derivative controller, a proportional-integral controller, or a proportional-integral-derivative (PID) controller. Each of the above-mentioned types of controllers are well known to those skilled in the art and need not be described further herein.

Pressure Regulating Apparatus Operation

Referring back to FIG. 2, operation of the illustrated pressure regulating apparatus 40 will now be described. High pressure fuel enters the pressure regulating apparatus 40 from the fuel rail 42 through the fuel inlet passageway 55 in the elongated body 50. The fuel exerts pressure on the regulating pin first end 70*a*. This pressure is measured by determining the stress imparted on the wall 59 of the elongated body 50 adjacent the fuel inlet passageway 55 as described above. The semiconductor element of the pressure sensing element 100 deflects in response to the imparted stress and the pressure sensing element 100 produces an output voltage proportional to the deflection of the semiconductor element that is proportional to the fuel pressure in the fuel inlet passageway 55. As would be understood by one of skill in the art, the fuel pressure measured in the fuel inlet passageway 55 will be the same as the fuel pressure within the fuel rail 42. The pressure sensing element 100 reports fuel pressure in the fuel rail 42 back to the vehicle ECU (24, FIG. 4).

To regulate fuel pressure within the fuel rail 42, the vehicle ECU 24 reads the fuel pressure output signal from the pressure sensing element 100 and determines what the proper fuel pressure should be based upon various vehicle parameters including, but not limited to, throttle position, engine speed (RPM), transmission gear, and wheel slip. The ECU 24 checks to see if the fuel pressure is where it should be, and if not, adjusts the signal to the pressure regulating apparatus 40 to change the fuel pressure to the desired level. As described above, fuel pressure is adjusted by applying electrical current to the coil 82. The generated magnetic field causes the magnetic armature 96 to move along the axial direction A toward the magnetic pole piece 94 towards an equilibrium position. As the armature 96 moves towards the pole piece 94, the pressure on the regulating pin first end 70*a* decreases because fuel can exit through the fuel outlet passageway 56, through the fuel rail second passageway 49, and back to the fuel tank 10.

The pressure regulating apparatus 40 can also act as a pressure relief valve if fuel pressure exceeds a predetermined pressure limit. Excessive fuel pressure applied to the regulating pin first end 70*a* can cause the spring 97 to compress, which will allow flow through the fuel outlet passageway 56, thereby reducing fuel pressure.

According to another embodiment of the present invention, a controller, such as a PID (30, FIG. 4), may be electrically connected with the pressure sensing element 100 to create a "smart solenoid" (i.e., a closed loop feedback control system is incorporated into the pressure sensing electronics), whereby fuel pressure can be maintained within a prescribed range of pressures. The controller 30 closes the loop around the sensed pressure via the pressure sensing element 100 and adjusts, via current induced within the coil 82, axial movement of the magnetic armature 96 within the inner tube 85 in order to maintain fuel pressure within a predetermined range.

By reading the pressure sensing element 100, the ECU 24 is able to see the effects that its changes are having on fuel pressure and can vary fuel pressure change requests. The control of how much change the ECU 24 asks the pressure sensing element 100 to make and how quickly it should make that change is usually controlled via PID control. A PID controller allows a system to control the amount of overshoot that a fuel rail sees from the pressure regulating apparatus 40 and also insures that the pressure regulating apparatus 40 receives the required value as fast as possible.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A pressure regulating apparatus for a fuel system, comprising:

a housing;

a body extending from the housing, comprising:

an axial bore extending through a portion thereof that defines a longitudinal direction;

a fuel inlet passageway in fluid communication with the axial bore;

a fuel outlet passageway in fluid communication with the axial bore; and a cavity formed in the body adjacent the fuel inlet passageway;

an elongate regulating pin slidably disposed within the axial bore, wherein the regulating pin includes opposite first and second ends, and wherein the regulating pin is movable within the axial bore along the longitudinal direction between an open position in which fuel may flow from the fuel inlet passageway into the axial bore and a closed position in which fuel flow from the fuel inlet passageway is blocked by the regulating pin first end;

means for moving the regulating pin between the open and closed positions to regulate fuel pressure within the fuel inlet passageway by allowing fuel entering the axial bore via the fuel inlet passageway to exit via the fuel outlet passageway; and a pressure sensing element positioned within the cavity, wherein the pressure sensing element is configured to generate electrical signals responsive to stresses imposed on the body adjacent the fuel inlet passageway caused by fuel pressure within the fuel inlet passageway.

2. A pressure regulating apparatus according to claim 1 wherein the regulating pin moving means comprises:

a tube having an elongated bore in communication with the body axial bore;

a magnetic pole piece disposed within the tube bore;

a magnetic armature slidably secured within the tube bore adjacent the magnetic pole piece, wherein the magnetic armature comprises opposite first and second ends;

means for biasing the magnetic armature away from the magnetic pole piece such that the magnetic armature first end is maintained in contacting relationship with the regulating pin second end; and a coil disposed within the housing, wherein the coil is configured to generate, responsive to electrical signals generated by the pressure sensing element, a magnetic field that moves the magnetic armature axially within the tube bore.

3. A pressure regulating apparatus according to claim 1 wherein the pressure sensing element comprises a semiconductor element.

4. A pressure regulating apparatus according to claim 3 wherein the semiconductor element comprises an embedded Wheatstone bridge.

5. A pressure regulating apparatus according to claim 1 further comprising a controller electrically connected with the pressure sensing element and configured to maintain fuel pressure in the fuel inlet passageway within a predetermined range of pressures, and wherein the controller is selected from the group consisting of proportional controllers, derivative controllers, integral controllers, proportional-derivative controllers, proportional-integral controllers, and proportional-integral-derivative controllers.

6. A pressure regulating apparatus for a fuel system, comprising:

a housing;

a body extending from the housing, comprising:

an axial bore extending through a portion thereof that defines a longitudinal direction;

a fuel inlet passageway in fluid communication with the axial bore via a;

a fuel outlet passageway in fluid communication with the axial bore; and a cavity formed in the body adjacent the fuel inlet passageway;

a regulating pin slidably disposed within the axial bore, wherein the regulating pin includes opposite first and second ends, and wherein the regulating pin is movable within the axial bore along the longitudinal direction between an open position in which fuel may flow from the fuel inlet passageway into the axial bore and a closed position in which fuel flow from the fuel inlet passageway is blocked by the regulating pin first end;

means for limiting movement of the regulating pin in a direction away from the fuel inlet passageway, wherein the movement limiting means is disposed within the axial bore;

means for moving the regulating pin between the open and closed positions to regulate fuel pressure within the fuel inlet passageway by allowing fuel entering the axial bore via the fuel inlet passageway to exit via the fuel outlet passageway; and a pressure sensing element positioned within the cavity, wherein the pressure sensing element is configured to generate electrical signals responsive to stresses imposed on the body adjacent the fuel inlet passageway caused by fuel pressure within the fuel inlet passageway.

7. A pressure regulating apparatus according to claim 6 wherein the regulating pin moving means comprises:

a tube having an elongated bore in communication with the body axial bore;

a magnetic pole piece disposed within the tube bore;

a magnetic armature slidably secured within the tube bore adjacent the magnetic pole piece, wherein the magnetic armature comprises opposite first and second ends;

an elongate member disposed within the body axial bore between the regulating pin and the magnetic armature, wherein the elongate member includes opposite first and second ends;

means for biasing the magnetic armature away from the magnetic pole piece such that the magnetic armature first end is maintained in contacting relationship with the elongate member first end and such that the elongate member second end is maintained in contacting relationship with the regulating pin second end; and a coil disposed within the housing, wherein the coil is configured to generate, responsive to electrical signals generated by the pressure sensing element, a magnetic field that moves the magnetic armature axially within the tube bore.

8. A pressure regulating apparatus according to claim 6 wherein the pressure sensing element comprises a semiconductor element.

9. A pressure regulating apparatus according to claim 8 wherein the semiconductor element comprises an embedded Wheatstone bridge.

10. A pressure regulating apparatus according to claim 6 further comprising a controller electrically connected with the pressure sensing element and configured to maintain fuel pressure in the fuel inlet passageway within a predetermined range of pressures, and wherein the controller is selected from the group consisting of proportional controllers, derivative controllers, integral controllers, proportional-derivative controllers, proportional-integral controllers, and proportional-integral-derivative controllers.

11. A direct injection fuel system for an internal combustion engine, comprising:

a fuel tank;

a fuel rail;

a fuel supply line connecting the fuel tank and the fuel rail;

a pump for pumping fuel from the fuel tank to the fuel rail via the fuel supply line;

a plurality of fuel injectors in fluid communication with the fuel rail, wherein each fuel injector is configured to directly inject fuel from the fuel rail into a respective combustion chamber within the internal combustion engine;

a pressure regulating apparatus that senses and regulates fuel pressure within the fuel rail, comprising:

a housing;

a body extending from the housing, comprising:

an axial bore extending through a portion thereof that defines a longitudinal direction;

a fuel inlet passageway in fluid communication with the axial bore;

a fuel outlet passageway in fluid communication with the axial bore; and a cavity formed in the body adjacent the fuel inlet passageway;

an elongate regulating pin slidably disposed within the axial bore, wherein the regulating pin includes opposite first and second ends, and wherein the regulating pin is movable within the axial bore along the longitudinal direction between an open position in which fuel may flow from the fuel inlet passageway into the axial bore and a closed position in which fuel flow from the fuel inlet passageway is blocked by the regulating pin first end;

means for moving the regulating pin between the open and closed positions to regulate fuel pressure within the fuel inlet passageway by allowing fuel entering the axial bore via the fuel inlet passageway to exit via the fuel outlet passageway; and a pressure sensing element positioned within the cavity, wherein the pressure sensing element is configured to generate electrical signals responsive to stresses imposed on the body adjacent the fuel inlet passageway caused by fuel pressure within the fuel inlet passageway.

12. A direct injection fuel system according to claim 11 wherein the regulating pin moving means comprises:

a tube having an elongated bore in communication with the body axial bore;

a magnetic pole piece disposed within the tube bore;

a magnetic armature slidably secured within the tube bore adjacent the magnetic pole piece, wherein the magnetic armature comprises opposite first and second ends;

means for biasing the magnetic armature away from the magnetic pole piece such that the magnetic armature first end is maintained in contacting relationship with the regulating pin second end; and a coil disposed within the housing, wherein the coil is configured to generate, responsive to electrical signals generated by the pressure sensing element, a magnetic field that moves the magnetic armature axially within the tube bore.

13. A direct injection fuel system according to claim 11 wherein the pressure sensing element comprises a semiconductor element.

14. A direct injection fuel system according to claim 13 wherein the semiconductor element comprises an embedded Wheatstone bridge.

15. A direct injection fuel system according to claim 11 further comprising a controller electrically connected with the pressure sensing element and configured to maintain fuel pressure in the fuel inlet passageway within a predetermined range of pressures, and wherein the controller is selected from the group consisting of proportional controllers, derivative controllers, integral controllers, proportional-derivative controllers, proportional-integral controllers, and proportional-integral-derivative controllers.

16. A direct injection fuel system for an internal combustion engine, comprising:

a fuel tank;

a fuel rail;

a fuel supply line connecting the fuel tank and the fuel rail;

a pump for pumping fuel from the fuel tank to the fuel rail via the fuel supply line;

a plurality of fuel injectors in fluid communication with the fuel rail, wherein each fuel injector is configured to directly inject fuel from the fuel rail into a respective combustion chamber within the internal combustion engine;

a pressure regulating apparatus that senses and regulates fuel pressure within the fuel rail, comprising:

a housing;

a body extending from the housing, comprising:

an axial bore extending through a portion thereof that defines a longitudinal direction;

a fuel inlet passageway in fluid communication with the axial bore via a;

a fuel outlet passageway in fluid communication with the axial bore; and a cavity formed in the body adjacent the fuel inlet passageway;

a regulating pin slidably disposed within the axial bore, wherein the regulating pin includes opposite first and second ends, and wherein the regulating pin is movable within the axial bore along the longitudinal direction between an open position in which fuel may flow from the fuel inlet passageway into the axial bore and a closed position in which fuel flow from the fuel inlet passageway is blocked by the regulating pin first end;

means for limiting movement of the regulating pin in a direction away from the fuel inlet passageway, wherein the movement limiting means is disposed within the axial bore;

means for moving the regulating pin between the open and closed positions to regulate fuel pressure within the fuel inlet passageway by allowing fuel entering the axial bore via the fuel inlet passageway to exit via the fuel outlet passageway; and a pressure sensing element positioned within the cavity, wherein the pressure sensing element is configured to generate electrical signals responsive to stresses imposed on the body adjacent the fuel inlet passageway caused by fuel pressure within the fuel inlet passageway.

17. A direct injection fuel system according to claim 16 wherein the regulating pin moving means comprises:

a tube having an elongated bore in communication with the body axial bore;

a magnetic pole piece disposed within the tube bore;

a magnetic armature slidably secured within the tube bore adjacent the magnetic pole piece, wherein the magnetic armature comprises opposite first and second ends;

an elongate member disposed within the body axial bore between the regulating pin and the magnetic armature, wherein the elongate member includes opposite first and second ends;

means for biasing the magnetic armature away from the magnetic pole piece such that the magnetic armature first end is maintained in contacting relationship with the elongate member first end and such that the elongate member second end is maintained in contacting relationship with the regulating pin second end; and a coil disposed within the housing, wherein the coil is configured to generate, responsive to electrical signals generated by the pressure sensing element, a magnetic field that moves the magnetic armature axially within the tube bore.

18. A direct injection fuel system according to claim 16 wherein the pressure sensing element comprises a semiconductor element.

19. A direct injection fuel system according to claim 18 wherein the semiconductor element comprises an embedded Wheatstone bridge.

20. A direct injection fuel system according to claim 16 further comprising a controller electrically connected with the pressure sensing element and configured to maintain fuel pressure in the fuel inlet passageway within a predetermined range of pressures, and wherein the controller is selected from the group consisting of proportional controllers, derivative controllers, integral controllers, proportional-derivative controllers, proportional-integral controllers, and proportional-integral-derivative controllers.

* * * * *